United States Patent [19]

Kubis et al.

[11] 4,392,764

[45] Jul. 12, 1983

[54] NECKED-IN CONTAINER BODY AND APPARATUS FOR AND METHOD OF FORMING SAME

[75] Inventors: Charles S. Kubis, Weston, Conn.; John Walter, Evergreen Park, Ill.

[73] Assignee: Continental Can Company, Inc., Stamford, Conn.

[21] Appl. No.: 303,685

[22] Filed: Sep. 18, 1981

[51] Int. Cl.[3] ..... B21D 51/26

[52] U.S. Cl. ..... 413/69; 72/354; 72/370

[58] Field of Search ..... 72/354, 370; 413/69, 413/77

[56] References Cited

U.S. PATENT DOCUMENTS

| | | | |
|---|---|---|---|
| 1,698,999 | 1/1929 | Hothersall | 72/370 |
| 2,174,967 | 10/1939 | Cartwright | 72/354 |
| 3,845,653 | 11/1974 | Hilgenbrink | 72/354 |

*Primary Examiner*—Francis S. Husar
*Assistant Examiner*—David B. Jones
*Attorney, Agent, or Firm*—Charles E. Brown

[57] ABSTRACT

This relates to the necking-in of a free end portion of a container, and particularly a very thin wall can body, utilizing necking-in tooling. The tooling differs from conventional tooling in that in addition to the necking-in operation, it also serves radially inwardly to turn the free edge portion of the container body to facilitate leading-in of the necked-in portion into another tubular container component with the in-turned free edge portion also providing a section modulus which effects stiffening and form retaining of the free end portion. In addition, it has been found that conventional necking-in tooling for aluminum can bodies having a free edge thickness on the order of 0.0075 inch will not perform satisfactorily on like can bodies having a free edge thickness on the order of 0.006 inch, and that surprisingly by increasing an adjacent radius, the tooling will perform satisfactorily. This abstract forms no part of the specification of this application and is not to be construed as limiting the claims of the application.

8 Claims, 4 Drawing Figures

NECKED-IN CONTAINER BODY AND APPARATUS FOR AND METHOD OF FORMING SAME

This invention particularly relates to a container body which is provided with a necked-in terminal portion which is to be telescoped within a further container component.

This invention in particular relates to the necking-in of a terminal portion of a container body and the forming of the terminal edge portion in a radially inwardly turned portion so as to facilitate telescoping of the necked-in portion into another tubular container component.

The radially inwardly turned terminal edge portion of the container body not only facilitates the leading in of the container body into another tubular container component, but also provides a section modulus which stiffens and maintains the roundness of the terminal edge of the container body.

The inwardly turned portion at the free edge of the container body may, in accordance with this invention, be automatically formed utilizing the tooling for effecting necking-in of the end portion of the container body. There is, however, the requirement that the inwardly turned portion be stripable from the conventional center ring of the tooling.

In accordance with this invention, a neck-in ring and a center ring are positioned in a predetermined telescoped relation wherein when a container body free end is telescoped relative thereto, the container body will engage the neck-in ring and will be deformed radially inwardly slightly above the center ring, after which the center ring and container body remain axially stationary relative to one another while telescoping of the container body and neck-in ring continue, and the neck-in ring is so configurated so that when it reaches its final position necking-in a free end portion of the container body, it will cooperate with the center ring inwardly to displace a terminal edge portion of the container body and will effect a curvature thereof which will stiffen the necked-in end of the container body while at the same time permit stripping of the container body from the center ring.

Another feature of this invention is the surprising results obtained by making minor changes in the dimension of radii of the neck-ring which will permit a necking-in tooling for a thicker metal to function with respect to thinner metal whereas tooling suitable for necking-in the thicker metal would not properly function.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
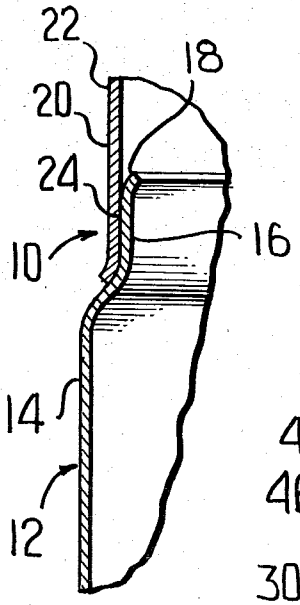
FIG. 1 is a fragmentary sectional view taken through a container which has formed as part thereof a container body formed in accordance with this invention, and shows the container body necked-in end portion telescoped within another container component.

Referring now to the drawings in detail, reference is first made to FIG. 1 wherein there is illustrated a portion of a container which is formed of at least two pieces, the container being generally identified by the numeral 10. The container 10 includes a lower container member 12 which includes a cylindrical body 14 and preferably is provided with an integral bottom end (not shown). In accordance with this invention, the container body 14 is provided with a necked-in upper terminal portion 16 which, in turn, terminates in a radially inwardly directed and curved free end portion 18.

The necked-in portion 16 is telescoped within a lower cylindrical body or skirt portion 20 of an upper container member 22. If desired, an adhesive layer 24 may be provided between the necked-in portion 16 and the container body 20. With or without the adhesive layer 24, it is preferred that the relative dimensions of the container body 20 and the necked-in portion 16 be such that there be an interference fit between them.

The inwardly turned terminal end portion 18 not only functions as a convenient lead-in for effecting telescoping of the necked-in portion 16 into the container body 20, but also functions as a section modulus to stiffen the necked-in portion 16 and to maintain the roundness thereof.

In accordance with this invention, the radially inwardly turned free end portion 18 is shaped as a final step in the operation wherein the portion 16 is necked-in.

Figure 2:
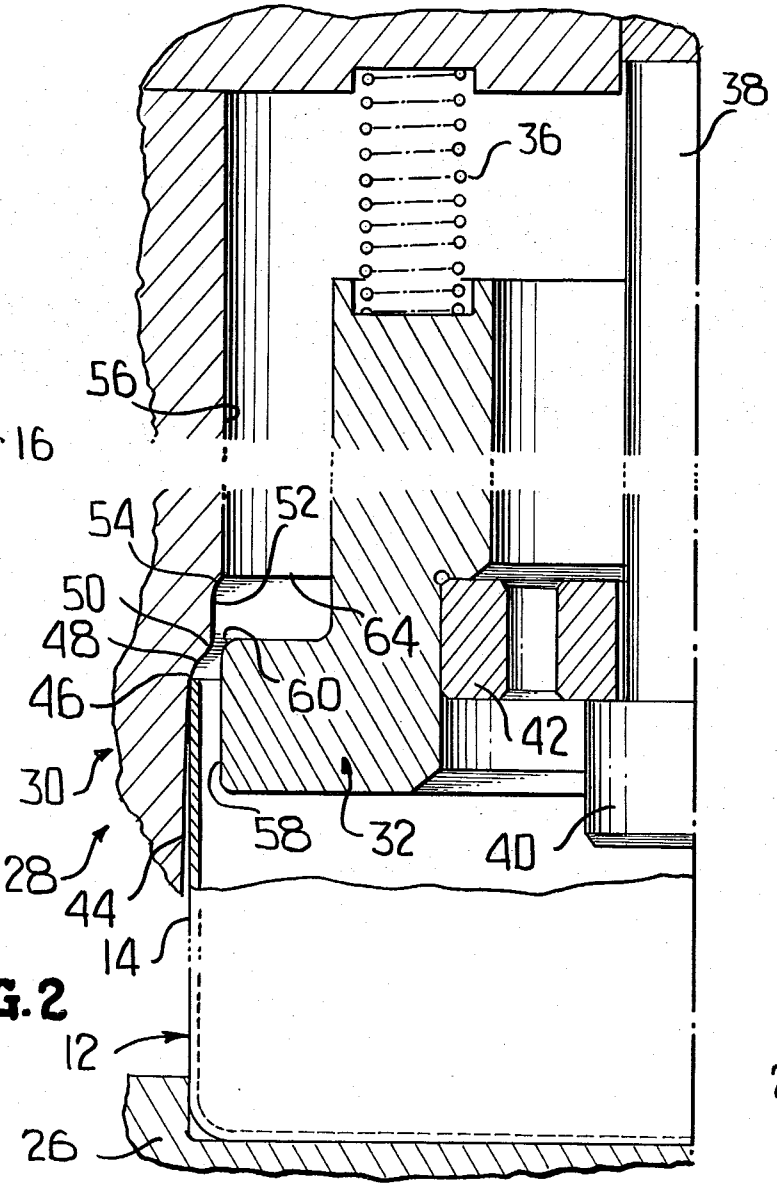
FIG. 2 is a half-sectional view with parts broken away and shown in section of tooling operative to effect the necking-in of the container body and forming therein an inwardly directed free edge portion in accordance with this invention.

Referring now to FIG. 2, it will be seen that there is illustrated suitable tooling for effecting the necking-in of the container body. This tooling includes a suitable support 26 on which the container member 12 is seated. Associated with the support 26 is necking-in tooling generally identified by the numeral 28.

The necking-in tooling includes a neck-in ring 30 which cooperates with a center ring 32. The neck-in ring 30 and the center ring 32 are illustrated as being carried by a press member or platen 34 with the neck-in ring 30 being fixedly positioned relative to the platen 34 while the centering ring 32 is urged away from the platen 34 by a compressible spring 36.

There is also provided a center post 38 which is fixed and is provided with a lower head 40 with which there is engaged a stop ring 42 carried by the center ring 32 and guided relative to the post 38. The head 40 serves to limit the downward movement of the center ring and the connection between the center ring and the platen 34 but the spring 36 permits the neck-in ring 30 and the platen 34 to continue to move downwardly after the center ring has reached the lower end of its travel.

The neck-in ring has an internal configuration which for the most part is conventional in neck-in rings. It has a lower generally cylindrical guide surface 44 which assures alignment of the upper part of the container body with the necking-in tooling 28. The guide surface 34 is generally cylindrical, but preferably has a slight taper as is clearly shown.

The guide surface 44 terminates in a first inturned radius 46 which connects to the guide surface 44 a frustoconical necking surface 48. The necking surface 48 terminates in an out-turned radius 50 which, in turn, terminates in a generally cylindrical outer sizing surface 52. The sizing surface 52 terminates in a second in-turned radius 54 which, in turn, terminates by intersecting with a cylindrical surface 56.

The center ring 52 is of a relatively simple construction and includes an outer cylindrical sizing surface 58 which, in turn, terminates in a third out-turned radius 60 which forms on the center ring 32 an upper rounded corner.

Conventionally, necking-in tooling includes a center ring and a neck-in ring of the general type illustrated. However, the relationship of the center ring and the neck-in ring with respect to the container body in the case of conventional cans is such that the necked-in terminal portion is relatively long so that it may have the free end portion thereof outwardly flanged to facilitate the forming of a customary double seam with a can end. Accordingly, the equivalent of the second in-turned radius 54 does not exist in conventional tooling and the upper part of the center ring is rounded only for the purpose of avoiding a sharp corner.

It is to be understood that the center ring and the neck-in ring positioned as shown with the out-turned radius 50 generally opposing the third in-turned radius 60 as shown in FIG. 2, the neck-in ring 30 and the center ring 32 are moved downwardly in unison and the container member 12 is either fixed or moved upwardly by means of the support 26 until the free upper edge of the container body engages the first in-turned radius 46 as shown in FIG. 2. At this point, necking-in is initiated and further telescoping movement of the center ring and neck-in ring relative to the container body will result in the radially inward deformation of the free end portion of the container body 14 to define a generally frustoconical end portion 62.

Figure 3:
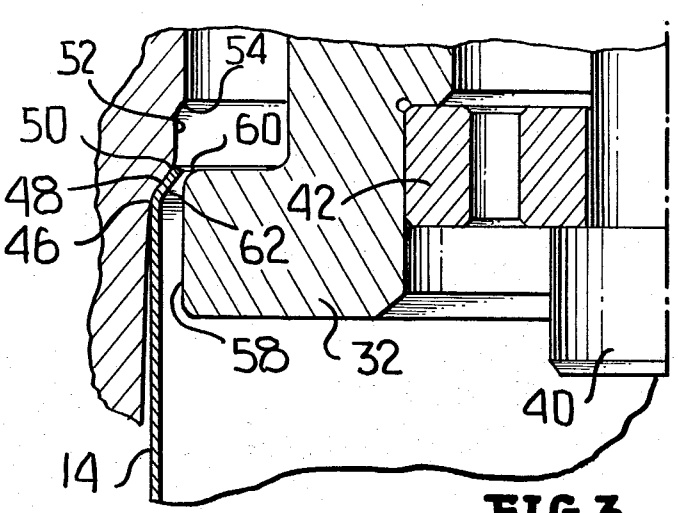
FIG. 3 is a fragmentary half-sectional view of the tooling having been telescoped further relative to the container body and showing the center ring as being in a final fixed position relative to the container body.

Telescoping of the tooling 28 with respect to the container body 14 continues until the necked-in portion 62 has the free edge thereof generally between and aligned with the out-turned radius 50 and the third in-turned radius 60 as is shown in FIG. 3. At this time, telescoping of the center ring relative to the container body ceases.

Figure 4:
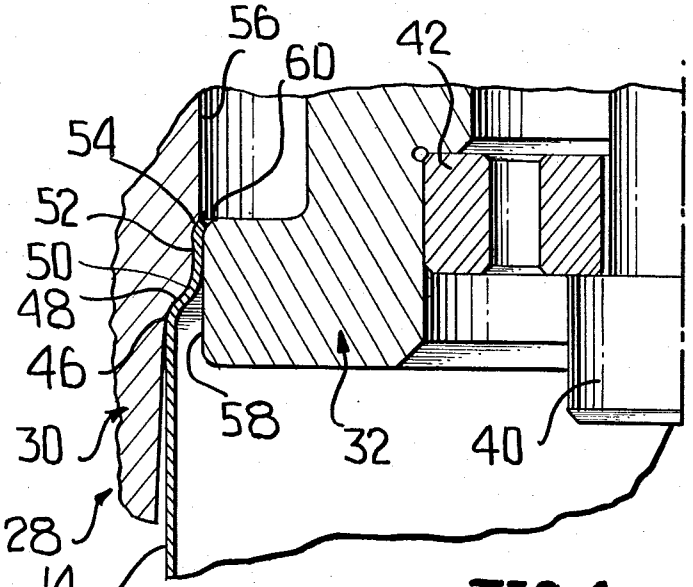
FIG. 4 is another fragmentary half-sectional view of the tooling, and shows the neck-in ring in a final position relative to the center ring and the container body and cooperating with the center ring both to neck-in a terminal portion of the container body and radially inwardly to deform the terminal edge portion of the container body.

Further telescoping of the tooling relative to the container body is now restricted to movement of the neck-in ring 30 both with respect to the container body 14 and the center ring 32 with the spring 36 being compressed. As is best shown in FIG. 4, as the neck-in ring 30 moves downwardly relative to the container body and the center ring, the sizing surface 52 will wipe down the initially necked-in portion 62 about the sizing surface 58 of the center ring and the container body will be progressively radially inwardly deformed by the action of the first in-turned radius 46 and the necking-in surface 48. The stroke of the platen 34 is such that movement of the neck-in ring 30 ceases when it reaches the position shown in FIG. 4 and wherein the free edge portion of the container body is engaged by the second in-turned radius and is radially inwardly directed. Since the second in-turned radius 54 now opposes the third in-turned radius 60, it cooperates with the third in-turned radius 60 not only radially inwardly to deform the free edge portion, but also to effect a rounding thereof between the two radii 54, 60.

At this time it is pointed out that the terminal end portion, which is the portion 18 of FIG. 1, is turned slightly around the center ring 32. It is also to be noted that the diameter of the sizing surface 58 of the center ring 32 is substantially equal to or slightly greater than the dimension of the surface 56 and most particularly with respect to a circular line 64 (FIG. 2) defining the intersection between the second in-turned radius 54 and the surface 56.

As previously mentioned, tooling which is devoid of means for forming the in-turned free end portion 18 has been utilized in the past to neck-in container bodies in a manner wherein end units of a diameter less than the diameter of the container body may be applied by a double seaming operation. Most particularly, aluminum can bodies having a free edge wall thickness on the order of 0.0075 inch have been successfully necked-in with such prior tooling. However, when the same diameter can body but with a wall thickness at the terminal edge of 0.006 inch were attempted to be necked-in with like tooling, undue wrinkling and otherwise unsatisfactory necking-in occurred. In that prior tooling the equivalent of the first in-turned radius 46 has a radius of 0.200 inch and the equivalent of the out-turned radius 50 had a radius of 0.050 inch. It has been surprisingly found that by reducing the radius of the first in-turned radius 46 to 0.100 inch and increasing the radius of the out-turned radius 50 to 0.080 inch, thinner wall can bodies could be successfully necked-in.

Although only a preferred embodiment of the invention has been illustrated and described herein, it is to be understood that minor variations may be made in the container construction, the tooling, and the method of utilizing the tooling without departing from the spirit and scope of the invention as defined by the appended claims.

We claim:

1. A method of necking-in a container body comprising the steps of providing a neck-in ring and a center ring; said neck-in ring having an inner generally cylindrical guide surface joined to a frustoconical necking surface by a first in-turned radius, an inner cylindrical sizing surface joined to said frustoconical necking surface by an out-turned radius, said sizing surface terminating in a second in-turned radius; and said center ring having an outer cylindrical sizing surface terminating in a third in-turned radius; positioning said outer cylindrical sizing surface in telescoped radially opposing relation to said guide surface and said necking surface with said third in-turned radius generally radially opposing said out-turned radius; and with said neck-in ring and said center ring in said telescoped radially opposing relation effecting relative telescoping thereof with a free end of a container body with the container body being guided into engagement with said first in-turned radius and said frustoconical necking surface and being radially inwardly shaped thereby until a free edge of the container body is generally overlapping said out-turned radius and said third in-turned radius; and then while retaining said center ring stationary relative to the container body continuing the telescoping of said neck-in ring and the container body until said second in-turned radius opposes said third in-turned radius to define on the container body a cylindrical end portion of reduced radius terminating in an in-turned terminal portion for facilitating the starting of the cylindrical end portion into telescoped relation with another container component.

2. A method in accordance with claim 1 wherein the container body in-turned terminal portion is radially inwardly curved by the cooperation of said in-turned radius engaging the free edge of the container body and forcing the free edge radially inwardly and around said third inturned radius.

3. A method according to claim 1 wherein the resultant diameter of the container free edge is less than that of said center ring only to the extent that the necked-in container body can be stripped from said center ring.

4. Neck-in tooling for necking-in a container body, said tooling comprising a neck-in ring and a center ring; said neck-in ring having an inner generally cylindrical guide surface joined to a frustoconical necking surface by a first in-turned radius, an inner cylindrical sizing surface joined to said frustoconical necking surface by an out-turned radius, said sizing surface terminating in a second in-turned radius; and said center ring having an outer cylindrical sizing surface terminating in a third in-turned radius; said second in-turned radius terminating in another inner surface of a diameter at its intersection with said second in-turned radius generally on the order of and substantially no less than the diameter of said center ring outer sizing surface whereby when said tooling is utilized to neck-in a container body a free end portion of the container body will be radially in-turned and curved in cross section by the cooperation of said second and third in-turned radii.

5. Tooling in accordance with claim 4 together with means of first moving said center ring and said neck-in ring in unison to a preselected telescoped position relative to a container body and thereafter with the container body and center ring relatively fixed separately advancing said neck-in ring.

6. Tooling in accordance with claim 4 wherein said tooling is particularly adapted for necking-in aluminum can bodies having a wall thickness at the free edge thereof on the order of 0.006 inch and wherein the radius of said first in-turned radius is decreased and the radius of said out-turned radius is increased as compared to similar tool for can bodies having a wall thickness at the free edge thereof on the order of 0.0075 inch.

7. Tooling in accordance with claim 6 wherein the radius of said first in-turned radius is on the order of 0.100 inch and the radius of said out-turned radius is on the order of 0.080 inch.

8. Tooling in accordance with claim 7 wherein the radius of said second in-turned radius is on the order of 0.060 inch and the radius of said third in-turned radius is on the order of 0.028 inch.

* * * * *